US008336124B2

(12) United States Patent
Crelinsten et al.

(10) Patent No.: US 8,336,124 B2
(45) **Date of Patent: *Dec. 25, 2012**

(54) UPPER BODY PROTECTIVE GARMENT

(75) Inventors: Ryan Crelinsten, Montreal (CA); Pierre Paiement, St-Jerome (CA); Anne-Marie Pelle, Montreal (CA); Patric Rangedal, Malung (SE); Leif Skottheim, Malung (SE)

(73) Assignee: Sport Maska Inc., Quebec (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/302,074

(22) Filed: Nov. 22, 2011

(65) Prior Publication Data

US 2012/0060268 A1 Mar. 15, 2012

Related U.S. Application Data

(63) Continuation of application No. 12/192,611, filed on Aug. 15, 2008, now Pat. No. 8,082,602.

(51) Int. Cl.

| | |
|---|---|
| ***A41D 27/26*** | (2006.01) |
| ***A41D 13/05*** | (2006.01) |
| *A41D 27/12* | (2006.01) |

(52) U.S. Cl. ..... 2/455; 2/456; 2/92; 2/267; 2/268; 2/467

(58) Field of Classification Search ..... 2/455, 456, 2/2.5, 459–467, 44, 45, 92, 267, 268, 908–911
See application file for complete search history.

(56) References Cited

U.S. PATENT DOCUMENTS

| | | | | |
|---|---|---|---|---|
| 1,316,915 A | | 9/1919 | Meyer et al. | |
| 2,108,336 A | * | 2/1938 | Helland | 2/462 |
| 2,163,463 A | * | 6/1939 | Kennedy | 2/462 |
| 2,805,418 A | * | 9/1957 | Sowle | 2/465 |
| 2,828,737 A | * | 4/1958 | Hale | 602/19 |
| 3,366,970 A | * | 2/1968 | Morgan | 2/462 |
| 3,509,579 A | * | 5/1970 | Morgan | 2/462 |
| 3,514,784 A | * | 6/1970 | McDavid | 2/468 |
| 3,514,786 A | * | 6/1970 | Terwilliger | 2/2.5 |

(Continued)

FOREIGN PATENT DOCUMENTS

| | | |
|---|---|---|
| DE | 3441876 | 5/1985 |

(Continued)

OTHER PUBLICATIONS

Koho Jofa 1997 Player Equipment Catalog, 1996, Karhu U.S. A., Inc. Canada.

*Primary Examiner* — Bobby Muromoto, Jr.
(74) *Attorney, Agent, or Firm* — Sterne, Kessler, Goldstein & Fox P.L.L.C.

(57) ABSTRACT

An upper body protective garment having a lower portion including flexibly interconnected protective abdominal and lower back members, an upper portion including protective thoracic and upper back members with a neck hole defined therebetween, a flexible front connection allowing at least limited movement of a bottom end of the thoracic member with respect to the abdominal member, and a flexible rear connection between the lower back member and the upper back member provided by a protective spinal member including flexibly interconnected rigid members for overlaying a spine of the wearer, the front and rear connections allowing the upper portion to remain at least substantially fixed with respect to shoulders of the wearer and the lower portion to remain at least substantially fixed with respect to a waist of the wearer while the shoulders and waist are moved relative to one another.

20 Claims, 6 Drawing Sheets

U.S. PATENT DOCUMENTS

| | | | | | |
|---|---|---|---|---|---|
| 3,739,397 | A | * | 6/1973 | Truelove | 2/462 |
| 4,322,858 | A | * | 4/1982 | Douglas | 2/463 |
| 4,425,667 | A | * | 1/1984 | Harrison | 2/462 |
| 4,453,271 | A | * | 6/1984 | Donzis | 2/456 |
| 4,467,475 | A | * | 8/1984 | Gregory et al. | 2/462 |
| 4,481,679 | A | * | 11/1984 | Hayes | 2/463 |
| 4,513,449 | A | * | 4/1985 | Donzis | 2/462 |
| 4,516,273 | A | * | 5/1985 | Gregory et al. | 2/462 |
| 4,554,681 | A | * | 11/1985 | Kirkland | 2/462 |
| 4,590,622 | A | * | 5/1986 | Wolfe et al. | 2/462 |
| 4,680,812 | A | | 7/1987 | Weigl | |
| 4,820,221 | A | | 4/1989 | Aubrey | |
| 4,866,789 | A | | 9/1989 | Dorm | |
| 4,870,706 | A | | 10/1989 | Ketcham et al. | |
| 4,884,295 | A | | 12/1989 | Cox | |
| 5,007,108 | A | * | 4/1991 | Laberge et al. | 2/463 |
| 5,029,341 | A | * | 7/1991 | Wingo, Jr. | 2/462 |
| 5,140,995 | A | * | 8/1992 | Uhl | 128/846 |
| 5,204,993 | A | * | 4/1993 | Siemens | 2/461 |
| 5,207,636 | A | | 5/1993 | Striano | |
| 5,245,706 | A | | 9/1993 | Moschetti et al. | |
| 5,249,306 | A | | 10/1993 | Morris | |
| 5,297,293 | A | | 3/1994 | Obujen | |
| 5,328,447 | A | * | 7/1994 | Kapounek et al. | 602/19 |
| 5,337,417 | A | | 8/1994 | Whiteside et al. | |
| 5,398,339 | A | | 3/1995 | Wagner | |
| 5,400,801 | A | * | 3/1995 | Archer, III | 128/846 |
| 5,402,742 | A | * | 4/1995 | Kiaulehn | 114/39.18 |
| 5,410,755 | A | | 5/1995 | Obujen | |
| 5,477,558 | A | * | 12/1995 | Volker et al. | 2/461 |
| 5,571,076 | A | | 11/1996 | Cooper | |
| 5,586,561 | A | * | 12/1996 | Archer, III | 128/846 |
| 5,619,747 | A | | 4/1997 | Boisclair et al. | |
| 5,623,728 | A | * | 4/1997 | Wagner | 2/462 |
| 5,652,967 | A | * | 8/1997 | Hsu | 2/463 |
| 5,669,873 | A | | 9/1997 | Towsley | |
| 5,768,717 | A | | 6/1998 | Le Sueur | |
| 5,840,051 | A | | 11/1998 | Towsley | |
| 5,915,543 | A | * | 6/1999 | Julin | 2/467 |
| 6,035,452 | A | | 3/2000 | Braxton | |
| 6,070,274 | A | | 6/2000 | van der Sleesen | |
| 6,117,096 | A | | 9/2000 | Hassard | |
| 6,260,196 | B1 | | 7/2001 | van der Sleesen | |
| 6,321,388 | B1 | | 11/2001 | Hildebrandt | |
| 6,427,695 | B1 | * | 8/2002 | Zanetti et al. | 128/846 |
| 6,453,791 | B1 | | 9/2002 | Seitzinger | |
| 6,499,149 | B2 | | 12/2002 | Ashline | |
| 6,558,020 | B1 | | 5/2003 | Holzer | |
| 6,625,814 | B1 | * | 9/2003 | Veh | 2/102 |
| 6,687,920 | B2 | * | 2/2004 | Berns | 2/467 |
| D489,845 | S | * | 5/2004 | Dainese | D29/100 |
| 6,748,601 | B2 | * | 6/2004 | LaShoto et al. | 2/102 |
| D492,819 | S | | 7/2004 | Béland | |
| D493,258 | S | | 7/2004 | Béland | |
| 6,772,439 | B1 | | 8/2004 | McMullen, Jr. | |
| 6,804,832 | B2 | | 10/2004 | Béland | |
| 6,845,522 | B2 | | 1/2005 | Béland | |
| 6,852,087 | B1 | | 2/2005 | Dainese | |
| 6,871,360 | B1 | | 3/2005 | Ashline | |
| 6,923,779 | B1 | | 8/2005 | Choiniere | |
| 6,925,652 | B2 | | 8/2005 | Feng | |
| 6,931,669 | B2 | | 8/2005 | Ashline | |
| 6,951,033 | B2 | | 10/2005 | Dainese | |
| 6,961,958 | B1 | | 11/2005 | Seitzinger | |
| 7,007,307 | B2 | | 3/2006 | Takeuchi | |
| 7,008,292 | B2 | | 3/2006 | Cosentino et al. | |
| 7,100,217 | B2 | | 9/2006 | Panzenböck et al. | |
| 7,103,924 | B2 | * | 9/2006 | Morrow et al. | 2/461 |
| 7,111,328 | B2 | | 9/2006 | Bay | |
| 7,329,230 | B2 | * | 2/2008 | Mazzarolo | 602/19 |
| 7,487,556 | B2 | | 2/2009 | Morrow et al. | |
| 7,797,760 | B2 | | 9/2010 | Morrow et al. | |
| 8,082,602 | B2 | * | 12/2011 | Crelinsten et al. | 2/455 |
| 2002/0069454 | A1 | * | 6/2002 | Beland | 2/462 |
| 2003/0130603 | A1 | | 7/2003 | Minne | |
| 2003/0167560 | A1 | * | 9/2003 | LaShoto et al. | 2/463 |
| 2004/0128748 | A1 | * | 7/2004 | Monica | 2/462 |
| 2004/0199983 | A1 | * | 10/2004 | Gillen et al. | 2/456 |
| 2005/0015858 | A1 | | 1/2005 | Ashline | |
| 2005/0102741 | A1 | * | 5/2005 | McQueer | 2/459 |
| 2005/0235392 | A1 | | 10/2005 | Bay | |
| 2006/0005305 | A1 | | 1/2006 | Haskell | |
| 2006/0010590 | A1 | * | 1/2006 | Huschke et al. | 2/459 |
| 2006/0053535 | A1 | * | 3/2006 | Ide et al. | 2/459 |
| 2006/0059609 | A1 | | 3/2006 | Moss | |
| 2006/0248632 | A1 | | 11/2006 | Colombo | |
| 2007/0214540 | A1 | * | 9/2007 | Bedard et al. | 2/69 |
| 2008/0127401 | A1 | * | 6/2008 | Cohen | 2/455 |
| 2008/0134419 | A1 | * | 6/2008 | Kalaam et al. | 2/463 |
| 2009/0209894 | A1 | * | 8/2009 | McAllister | 602/19 |

FOREIGN PATENT DOCUMENTS

| | | |
|---|---|---|
| DE | 39 00 694 | 7/1990 |
| EP | 1 216 728 A2 | 6/2002 |
| FR | 2 706 318 | 12/1994 |

* cited by examiner

UPPER BODY PROTECTIVE GARMENT

CROSSS-REFERENCE TO RELATED APPLICATION

This application is a continuation of U.S. patent application Ser. No. 12/192,611, filed Aug. 15, 2008, the entire disclosure of which is incorporated herein be reference thereto.

FIELD OF THE INVENTION

The present application relates to protective garments, and more particularly to such garments used in contact sports like hockey.

BACKGROUND ART

In contact sports like hockey, protective equipment must be worn to limit the risk of injury during play. The amount of protection that can be provided by the equipment is generally limited by the restrictions the protective equipment will bring to the movements of the wearer, and as such compromise must be made between safety and comfort.

Upper body protective equipment typically includes rigid protective plates in locations most susceptible to injury and/or most vulnerable, for example the sternum, the shoulders and the spine. However, the use of rigid protective plates increases the bulkiness of the protective equipment, thus its tendency to shift with respect to the body of the wearer when the torso is rotated, such as for example when performing a slap shot in hockey. This shift can cause discomfort and/or leave previously protected parts of the torso unprotected, thus susceptible to injury. Tightening of the protective equipment around the torso can limit this shift, but however generally increases the restriction of movement brought about by the protective equipment.

SUMMARY

In accordance with the present invention, there is provided an upper body protective garment comprising a lower portion including a protective abdominal member and a protective lower back member, the abdominal and lower back members being flexibly interconnected such as to be wearable around a waist of a wearer with a snug fit, an upper portion including a protective front thoracic member and protective upper back member with a neck hole defined therebetween, the front thoracic member at least partially overlaying the abdominal member, a flexible front connection between the abdominal member and the front thoracic member, the front connection allowing at least limited movement of a bottom end of the front thoracic member with respect to the abdominal member, and a flexible rear connection between the lower back member and the upper back member, the rear connection being provided at least in part by a protective spinal member including flexibly interconnected rigid members for overlaying a spine of the wearer, the front and rear connections allowing the upper portion to remain in an at least substantially fixed position with respect to shoulders of the wearer and the lower portion to remain in an at least substantially fixed position with respect to a waist of the wearer while the shoulders and waist are moved relative to one another.

Also in accordance with the present invention, there is provided an upper body protective garment comprising a waist assembly for surrounding a waist of a wearer, a protective back member for protecting a back of the wearer, the back member having a lower portion connected to the waist assembly and an upper portion opposite of the lower portion, the back member including a protective spinal member extending between the upper and lower portions, the spinal member providing at least a limited relative rotational range of motion about three perpendicular axes between the upper and lower portions of the back member, shoulder portions extending from the upper portion of the back member for overlaying shoulders of the wearer, and a protective front thoracic member for overlaying at least a sternum of the wearer, the front thoracic member having a top end connected to the shoulder portions and a bottom end opposite of the top end, the bottom end of the front thoracic member being movable with respect to the waist assembly along at least a limited path, wherein at least the spinal member and the front thoracic member include rigid protective material.

BRIEF DESCRIPTION OF THE DRAWINGS

Reference will now be made to the accompanying drawings, showing by way of illustration a particular embodiment of the present invention and in which.

DETAILED DESCRIPTION OF PARTICULAR EMBODIMENTS

Figure 1:
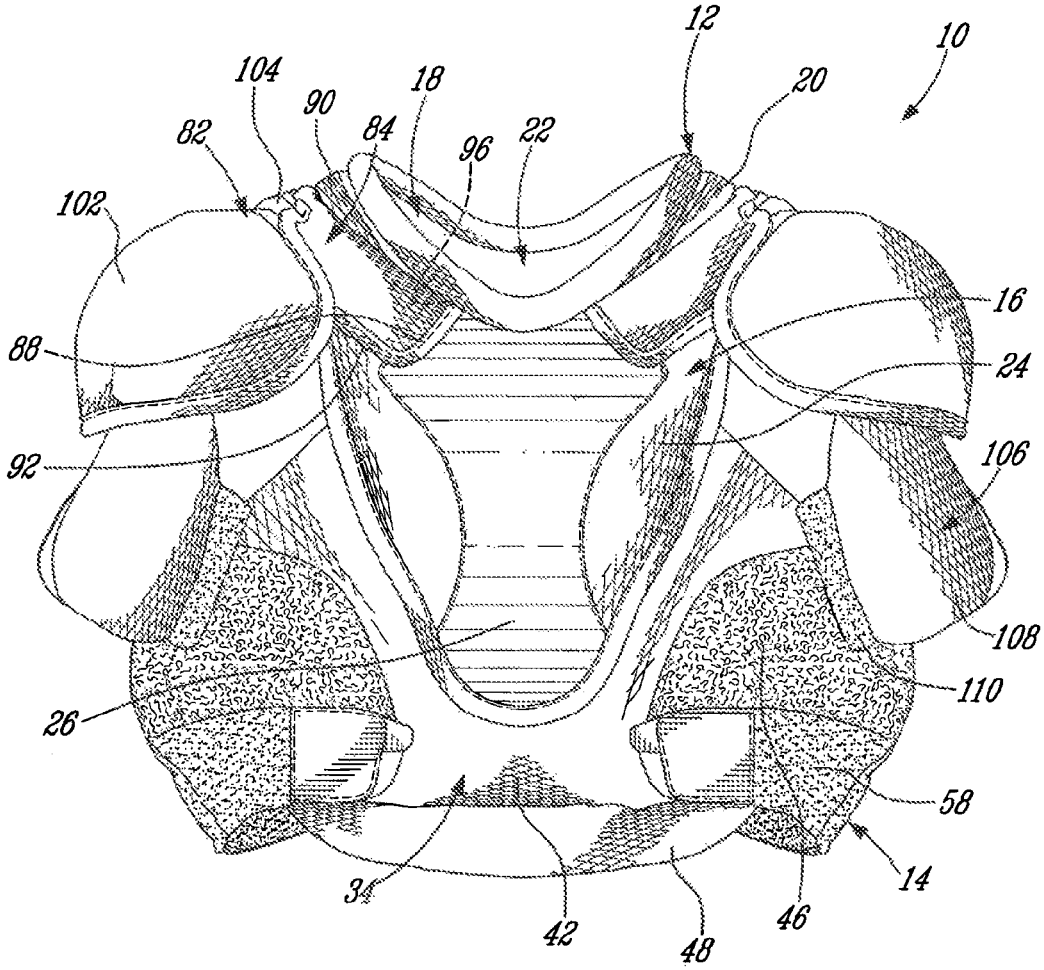
FIG. 1 is a schematic front view of an upper body protective garment according to a particular embodiment of the present invention.
Figure 2:
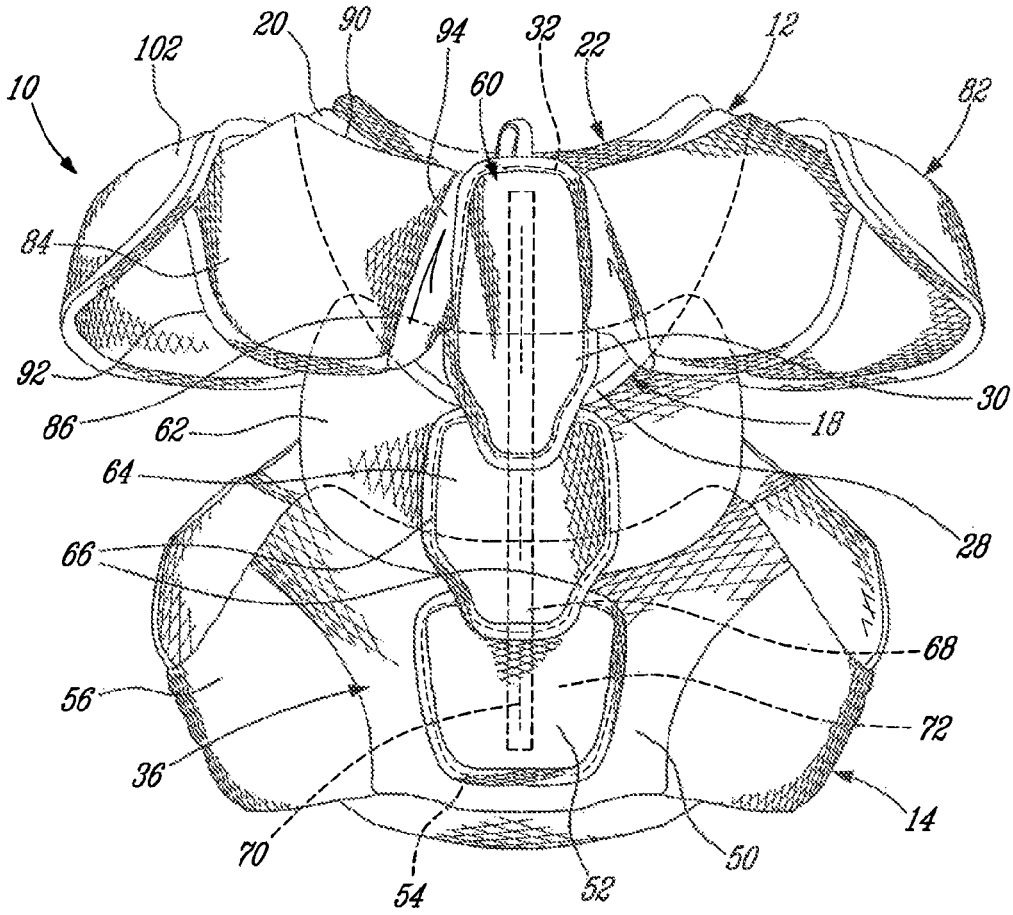
FIG. 2 is a schematic rear view of the garment of FIG. 1, with protective upper arm members thereof removed.
Figure 3:
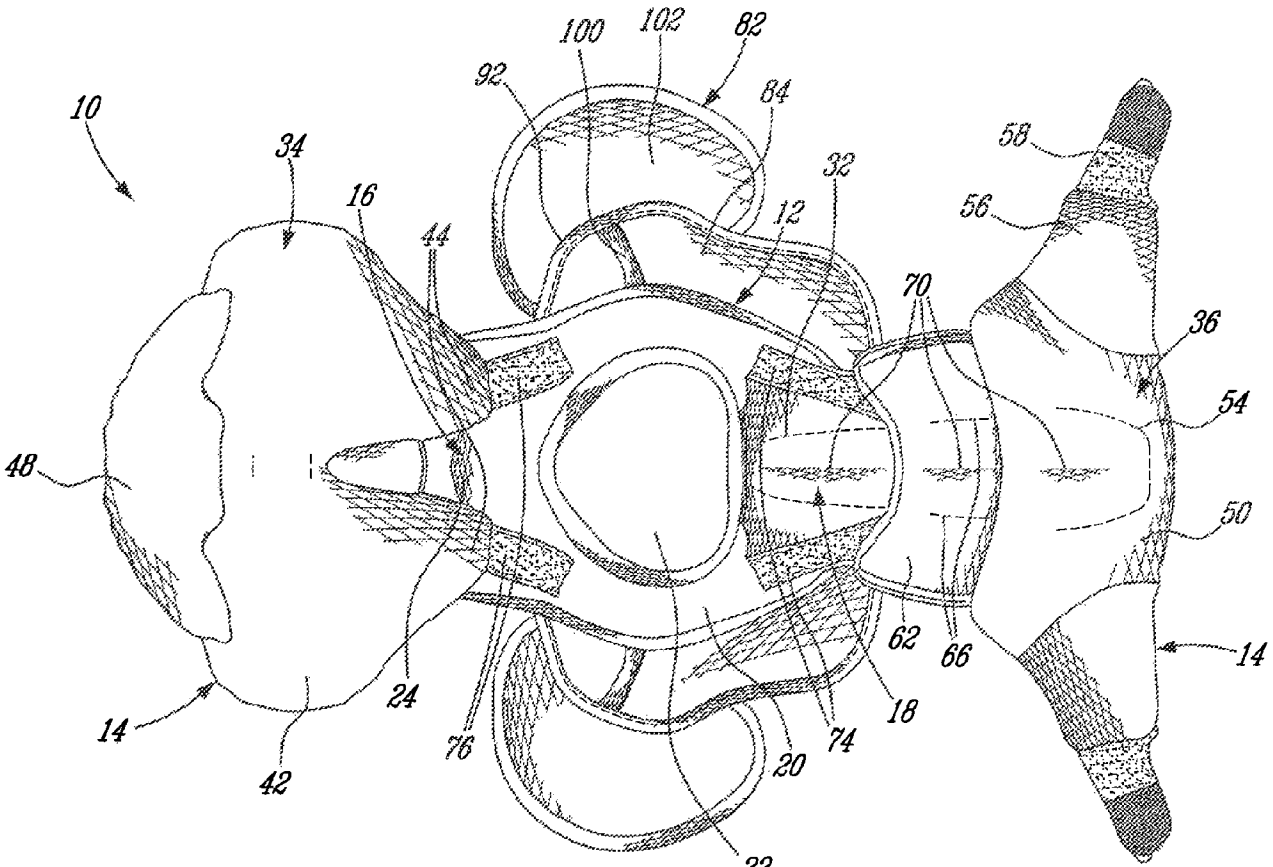
FIG. 3 is a schematic underside view of the garment of FIG. 2 in a flat configuration.

Referring to FIGS. 1-3, an upper body protective garment 10 according to a particular embodiment of the present invention is shown. The protective garment 10 includes generally an upper portion 12 and a lower portion 14.

The upper portion 12 of the garment 10 generally comprises a protective front thoracic member 16, a protective upper back member 18, and shoulder portions 20 extending therebetween. A neck hole 22 is defined in the upper portion 12 and is bordered by the front thoracic member 16, upper back member 18 and shoulder portions 20.

Referring to FIG. 1, the front thoracic member 16 includes a protective front thoracic pad 24 made of flexible protective padding contained within an envelope of an adequate type of fabric. The front thoracic pad 24 has a rounded triangular shape which in the embodiment shown covers a major portion of the front of the thorax of the wearer. The front thoracic member 16 also includes a rigid sternal plate 26 affixed on top of the front thoracic pad 24 along its center, such as to overlap the sternum of the wearer. The sternal plate 26 provides for increased shock absorbency for the sternum.

Referring to FIGS. 2-3, the upper back member 18 includes a protective upper back pad 28 also made of flexible protective padding contained within an envelope of an adequate type of fabric. The upper back pad 28 has a semi-oval shape and extends over part of the shoulder blades and an upper portion of the spine. The upper back member 18 also includes an elongated rigid upper spinal plate 30 overlaying the upper back pad 28 along a center thereof. The upper spinal plate 30 is connected to the upper back pad 28 along its edges through an inverted U-shaped stitch line 32, thus leaving the center of the upper spinal plate 30 free from the underlying pad 28. As such, part of an elongated channel is formed between the upper spinal plate 30 and the upper back pad 28, which will be discussed in more detail further below.

In the embodiment shown and as can be seen in FIG. 3, the upper back pad 28, front thoracic pad 24 and shoulder portions 20 are formed as a single element, and as such the shoulder portions 20 are also formed of flexible protective padding contained within an envelope of an adequate type of fabric. Alternately, the shoulder portions 20 can be separate elements, and for example be provided as suspender-type straps connected to the front thoracic pad 24 and the upper back pad 28.

The lower portion 14 of the garment 10 generally includes a protective abdominal member 34 and a protective lower back member 36 which are interconnected to form a waist assembly for surrounding the waist of the wearer, preferably with a snug fit.

Referring to FIGS. 1 and 3, the abdominal member includes a protective abdominal pad 42 also made of flexible protective padding contained within an envelope of an adequate type of fabric. The abdominal pad 42 has a generally oval shape with two interconnected fingers 44 extending upwardly therefrom, as can be seen in FIG. 3. The abdominal pad 42 extends at least partially under the front thoracic member 16, with the sternal plate 26 generally overlaying an opening defined between the fingers 44. The abdominal pad 42 includes fasteners 46 on a front surface thereof, which in the embodiment shown are in the form of patches of loop portions of hook and loop type fasteners such as Velcro®. The abdominal member 34 may also include an optional protective additional pad 48 detachably connected along a bottom edge of the abdominal pad 42.

Referring to FIG. 2, the lower back member 36 includes a protective lower back pad 50 also made of flexible protective padding contained within an envelope of an adequate type of fabric. The lower back pad 50 has a rounded trapezoidal shape and extends over a lower portion of the back, including the kidneys and spine. The lower back member 36 also includes a rigid lower spinal plate 52 overlaying the lower back pad 50 along a center thereof. The lower spinal plate 52 is connected to the lower back pad 50 along its edges through a U-shaped stitch line 54, thus leaving the center of the lower spinal plate 52 free from the underlying pad 50. As such, part of the elongated channel is also formed between the lower spinal plate 52 and the lower back pad 50.

The lower back member 36 further includes rigid kidney caps 56 retained over the lower back pad 50 to overlay the kidneys. In a particular embodiment the kidney caps 56 are contained within the envelope of the lower back pad 50 surrounding the flexible protective padding, and retained in a pocket formed therein by stitching. Depending on the desired degree of protection, the kidney caps 56 can alternately be omitted.

The lower back member 36 further includes belt elements 58 extending from the lower back pad 50 adjacent each of the kidney caps 56, with free ends of the belt elements 58 including hook portions of hook and loop type fasteners for engagement with the loop fasteners 46 of the abdominal pad 42. Other adequate types of complementary fasteners can also be alternately provided on the belt elements 58 and on the abdominal pad 42.

Depending on the desired degree of protection, the abdominal pad 42 can be omitted from the lower portion 14 of the garment 10, in which case the waist assembly is defined by having for example the belt elements 58 engaging each other, or be replaced by a single belt element extending from one side of the lower back pad 50 and engaging the other side thereof.

Referring to FIG. 2, the garment 10 also includes a protective spinal member 60 which flexibly interconnects the upper and lower portions 12, 14 of the garment 10 along the spine of the wearer. In the embodiment shown, the upper and lower back members 18, 36 each define a part of the spinal member 60, which further includes a protective intermediate back pad 62 also made of flexible protective padding contained within an envelope of an adequate type of fabric, as well as a rigid intermediate spinal plate 64 overlaying the intermediate back pad 62. The intermediate back pad 62 has a crescent shape and covers the back between the upper and lower back pads 28, 50. The intermediate spinal plate 64 is connected to the intermediate back pad 62 along its edges by two spaced apart stitch lines 66, thus leaving the center of the intermediate spinal plate 64 free from the underlying pad 62 to define another part of the elongated channel therebetween.

In the embodiment shown, the bottom end of the upper back pad 28 overlaps the top end of the intermediate back pad 62 and the bottom end of the intermediate back pad 62 overlaps the top end of the lower back pad 50. Similarly, the bottom end of the upper spinal plate 30 overlaps the top end of the intermediate spinal plate 64 and the bottom end of the intermediate spinal plate 64 overlaps the top end of the lower spinal plate 52.

Figure 6:
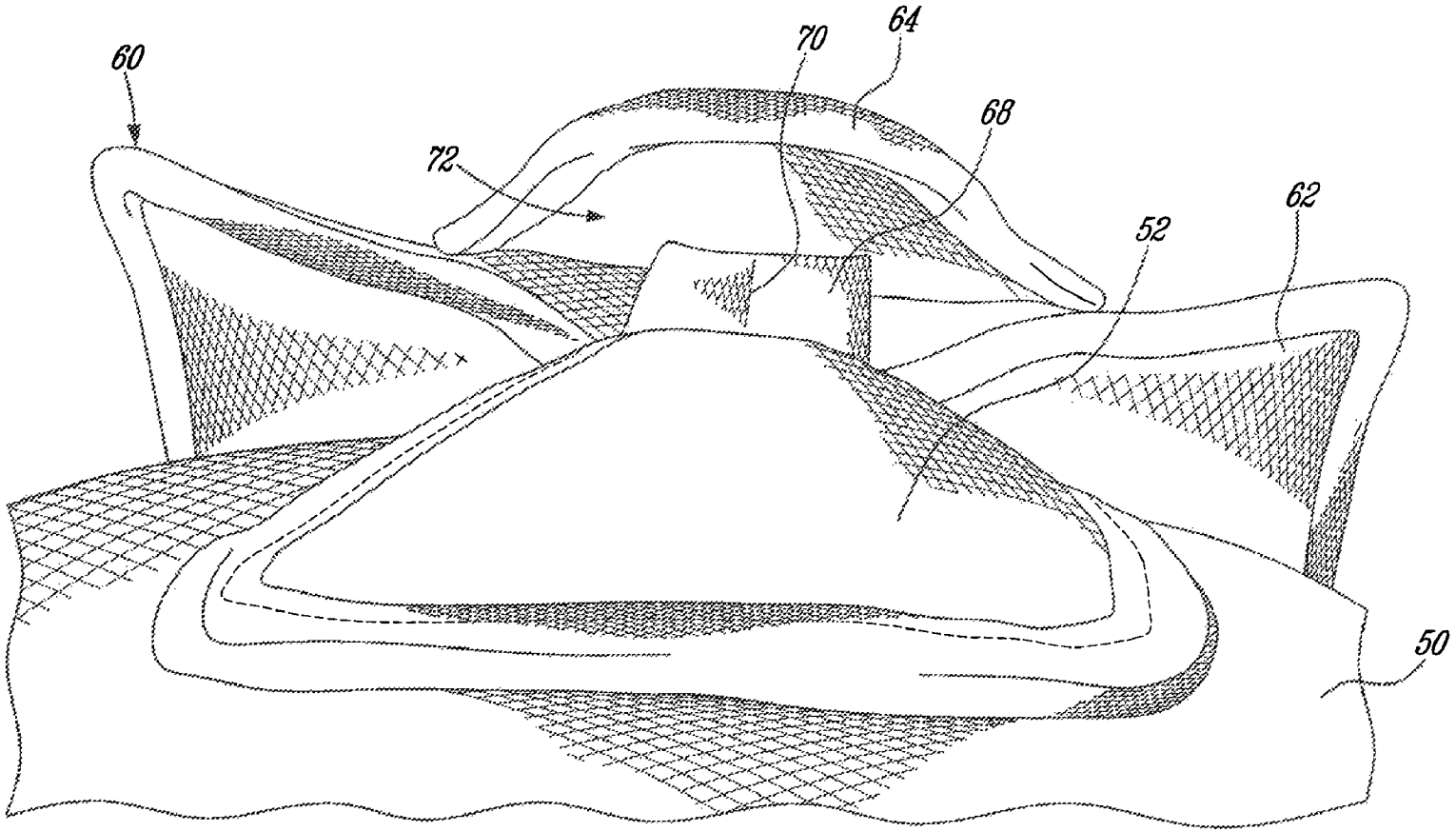
FIG. 6 is a schematic partial bottom view of the garment of FIG. 1 with a protective spinal member thereof in a flexed configuration.

Referring to FIGS. 2 and 6, the upper, intermediate and lower back pads 28, 62, 50 are interconnected by a flexible strip 68 which is stitched thereover through stitch lines 70 and extends through the elongated channel 72 defined between the pads 28, 50, 62 and the spinal plates 30, 52, 64 along the length of the spinal member 60. The spinal plates 30, 52, 64 are thus flexibly interconnected through the connection between the back pads 28, 50, 62 provided by the flexible strip 68.

The spinal member 60 thus provides a flexible connection between the upper and lower portions 12, 14 of the garment 10 along the back thereof. This flexible rear connection allows for a certain amount of relative rotation between the upper and lower portions 12, 14 about the three perpendicular axes (i.e. lateral flexion, forward/limited rearward flexion, and torsion) while providing protection to the spine. The spinal member 60 can alternately include more than one intermediate back pad and intermediate spinal plate assembly. Alternately, the intermediate back pad 62 and spinal plate 60 can be omitted, for example by having the upper back pad and plate 28, 30 partially overlapping the lower back pad and spinal plate 50, 52, respectively. Other adequate spinal member configurations allowing for a certain amount of relative rotation between the upper and lower portions 12, 14 of the garment 10 about the three perpendicular axes while providing protection to the spine can also alternately be used.

The spinal member 60 thus defines a protective back member allowing for a rotational range of motion between its top end which is part of the upper back member 18 and its bottom end which is part of the lower back member 36, the rotational range of motion including one or a combination of lateral flexion, forward/limited rearward flexion and torsion.

Referring to FIG. 3, in the embodiment shown, the intermediate back pad 62 includes two flexible rear straps 74 extending from a top end thereof and connected to an underside of the upper back pad 28, thus forming another part of the flexible rear connection between the two portions 12, 14 through the intermediate back pad 62. In an alternate embodiment, these rear straps 74 are omitted.

Figure 4:
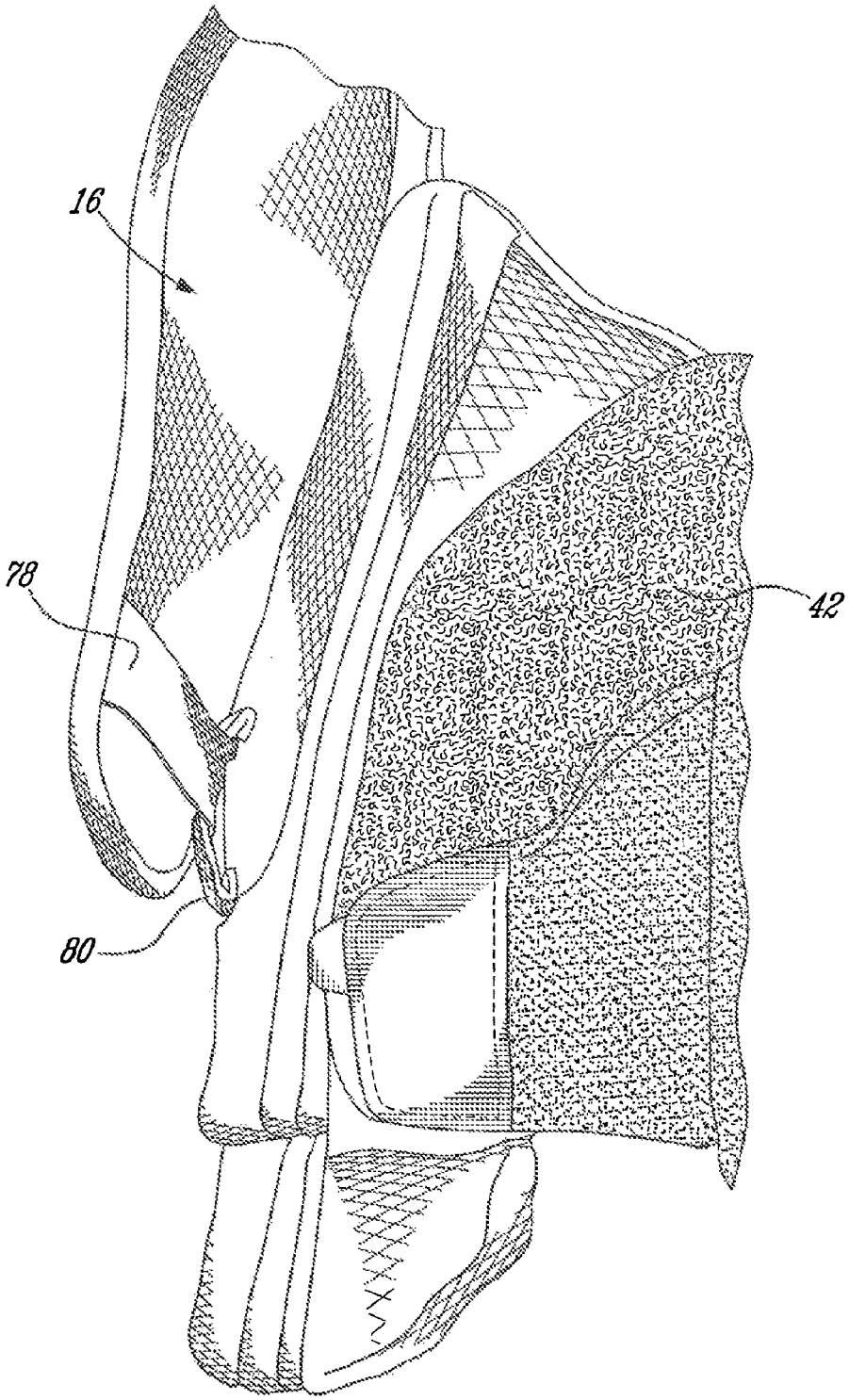
FIG. 4 is a schematic partial side view of a protective front thoracic member and a protective abdominal member of the garment of FIG. 1, showing a connection therebetween.
Figure 5:
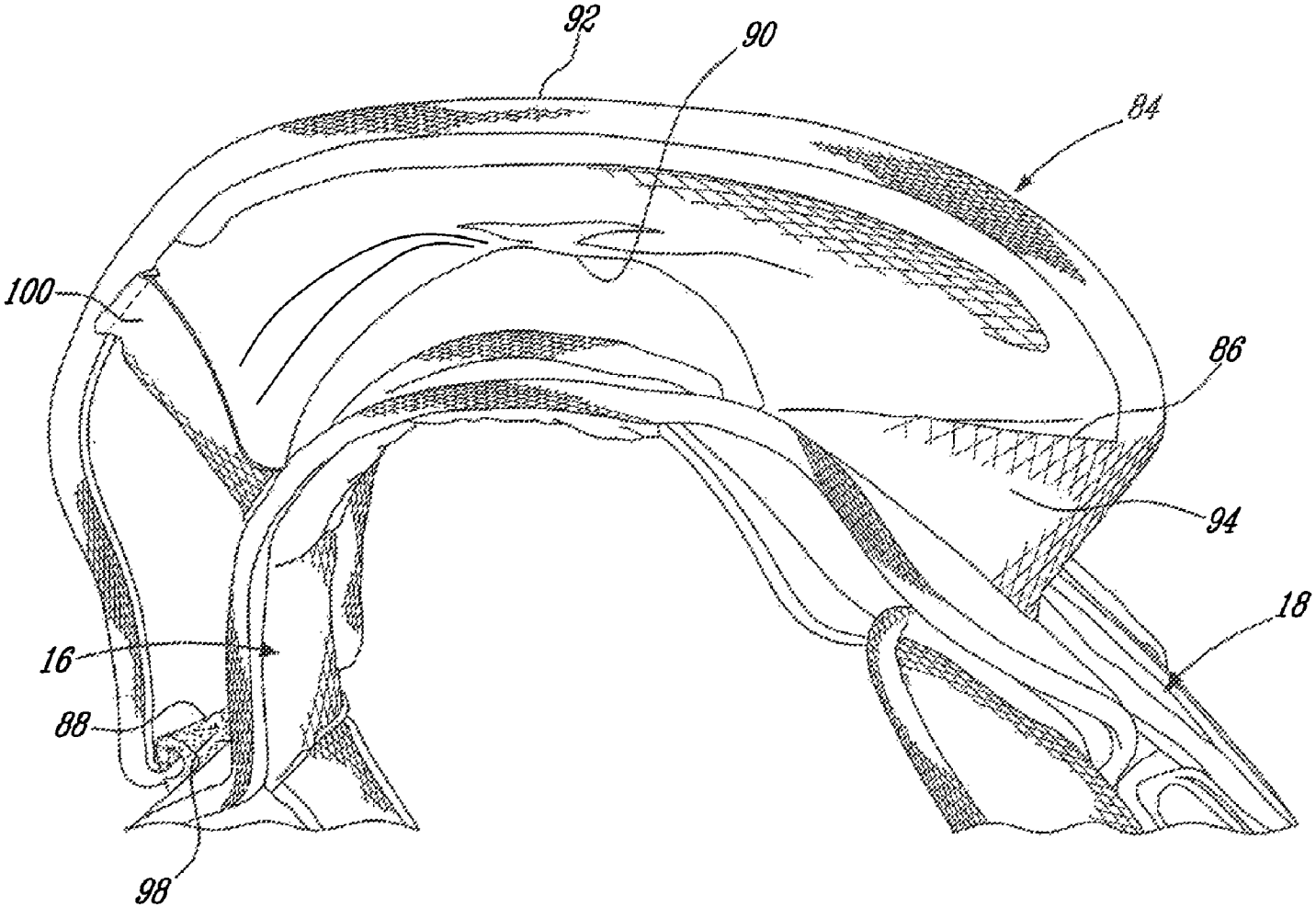
FIG. 5 is a schematic partial side view of the garment of FIG. 1 with shoulder caps thereof omitted for improved clarity, showing a protective shoulder pad thereof in a pivoted position.

Still referring to FIG. 3, a flexible front connection between the two portions 12, 14 includes two flexible front straps 76 extending from a top end of the abdominal member 34 and attached to an underside of the front thoracic pad 24. Referring to FIG. 4, the flexible front connection further includes a loose connection formed by a first strap loop 78 extending from the front thoracic member 16 engaged within a second strap loop 80 extending from the abdominal pad 42, which provides for a limited relative range of motion between the bottom end of the front thoracic member 16 and the abdominal member 34. Other adequate types of connections between the front thoracic member 16 and the abdominal member 34 allowing this limited relative range of motion can alternately be provided, or the connection can alternately be omitted for an increased relative range of motion between the bottom end of the front thoracic member 16 and the abdominal member 34.

The front connection between the upper and lower portions 12, 14 of the garment 10 allows for relative motion between the two portions 12, 14 in a range at least corresponding to the motion allowed by the rear connection and particularly by the spinal member 60. Other adequate configurations for the front connection allowing for such relative motion can alternately be used.

The flexible connections between the upper and lower portions 12, 14 of the garment 10 thus allow the garment 10 to compensate at least partially for various movements of the wearer where the shoulders and waist move differently, for example movements including flexion and torsion of the torso such as a slap shot in hockey. This allows the waist assembly or lower portion 14 of the garment 10 to tightly surround the waist and remain in an at least substantially constant position with respect thereto, while performing rotational movements of the torso (i.e. lateral flexion, forward/limited rearward flexion, and/or torsion) with the upper portion remaining in at least a substantially constant position relative to the wearer's shoulders. Accordingly, the movement restrictions caused by the garment 10 are minimized while still providing substantial impact protection.

Referring to FIGS. 1-3 and 5, in a particular embodiment, the upper portion 12 also includes protective shoulder members 82 each including a protective shoulder pad 84 also made of protective padding contained within an envelope of an adequate type of fabric. The shoulder pad 84 has an elongated shape and extends over the shoulder to cover the clavicle over the front thoracic pad 24 and the shoulder blade over the upper back pad 28. In a particular embodiment, the shoulder pad 84 is more flexible than the sternal and spinal plates 26, 30, 52, 64 but more rigid than back pads 28, 50, 62, the front thoracic pad 24 and the abdominal pad 42. The shoulder pad 84 includes a rear end 86 and a front end 88, as well as an upper or neck edge 90 and a lower edge 92 extending therebetween. The rear end 86 is flexibly connected to the upper back member 18 by a flexible fabric portion 94 free of padding. The front end 88 is flexibly connected to the front thoracic member 16 by a small stitch line 96 (see FIG. 1) in a corner thereof adjacent the neck hole 22 and by an elastic strap 98 in the opposed corner. The upper edge 90 extends freely of a remainder of the upper portion 12 of the garment 10. The lower edge 92 also extends freely of the remainder of the upper portion 12, with the exception of an elastic strap 100 which is preferably provided between the lower edge 92 and the shoulder portion 20 underneath. Alternately, the elastic strap 100 can be omitted.

Each shoulder member 82 further includes a rigid shoulder cap 102 contained within an envelope of an adequate type of fabric. The shoulder cap 102 partially overlaps the shoulder pad 84 and is hingedly connected thereto by a flexible strap 104 (see FIG. 1).

The shoulder member 82 configuration advantageously allows for a substantial range of motion thereof independently of the remainder of the upper portion 12, thus also reducing the relative motion between the body and the garment 10 when performing various movements during play.

Referring again to FIG. 1, the upper portion 12 can optionally include protective upper arm members 106 which include a protective upper arm pad 108 made of protective padding contained within an envelope of an adequate type of fabric. In a particular embodiment, the upper arm pad 108 has a rigidity similar to that of the shoulder pad 84. The upper arm member 106 further includes a strap element 110 extending therefrom to form a loop for surrounding the arm, one of the ends of the strap element 110 being detachably connected to the upper arm member 106, for example through hook and loop type fasteners (not shown). Each upper arm member 106 is detachably connected to the respective shoulder member 82, for example by a strap (not shown) extending from the upper arm member 106 and engaging a loop (not shown) provided on the shoulder member 82.

Possible materials for the garment 10 include, but are not limited to, an adequate type of foam such as polyethylene foam for the flexible protective padding of the front thoracic pad 24, the back pads 28, 50, 62, the shoulder portions 20 and/or the abdominal pad 42, an adequate type of foam such as high density polyethylene foam or an adequate type of plastic such as polyethylene for the shoulder pads 84 and/or the upper arm pads 108, a high density polyethylene foam, a combination of high density and low density polyethylene foam, or a combination of low density polyethylene foam and plastic insert for the sternal plate 26, kidney caps 56 and/or shoulder caps 102, and/or an adequate type of molded plastic such as polyethylene for the spinal plates 30, 52, 64. The fabric used to envelope the protective material is preferably an adequate type of breathable and/or mesh and/or wicking material. It is understood that any other adequate material or combination of materials can alternately be used in any portion of the garment 10.

The embodiments of the invention described above are intended to be exemplary. Those skilled in the art will therefore appreciate that the foregoing description is illustrative only, and that various alternate configurations and modifications can be devised without departing from the spirit of the present invention. For example, the specific structure including but not limited to shape, materials and construction of each of the protective members 16, 18, 34, 36, 60, 82, 106 can be varied as long as the protective member can perform its protective function. Protective members can be combined, replaced by two or more smaller members, or in some cases, omitted. Other variations are also possible. Accordingly, the present invention is intended to embrace all such alternate configurations, modifications and variances which fall within the scope of the appended claims.

The invention claimed is:

1. An upper body protective garment comprising:

a protective abdominal member wearable around at least a portion of the waist of a wearer, the abdominal member having an upper edge;

a protective front thoracic member for overlaying at least a sternum of the wearer, the front thoracic member having a top end and a bottom end opposite of the top end, the bottom end extending below the upper edge of the abdominal member;

a first strap extending from an underside of the front thoracic member; and a second strap extending from the abdominal member, wherein the first strap and the second strap are interconnected to provide a movable connection between the front thoracic member and the abdominal member.

2. The protective ga went according to claim 1, further comprising a flexible strap connecting the abdominal member to an underside of the thoracic member.

3. The protective garment according to claim 1, wherein the second strap connects to the abdominal member at an upper connection point and a lower connection point, and wherein the front thoracic member extends below the upper connection point.

4. The protective garment according to claim 1, wherein the first strap extends horizontally from the front thoracic member and the second strap extends vertically from the abdominal member.

5. The protective garment according to claim 1, wherein the first strap and the second strap interconnect to allow relative movement of the front thoracic member with respect to the abdominal member along a limited path.

6. The protective garment according to claim 1, wherein the front thoracic; member comprises a single member extending over the center of the chest of the wearer.

7. The protective garment according to claim 1, further comprising:

a protective lower back member, wherein the abdominal and lower back members are flexibly interconnected so as to be wearable around a waist of a wearer with a snug fit; and a protective upper back member, wherein the front thoracic and upper back members define a neck hole.

8. The protective garment according to claim 7, further comprising;

a pair of protective shoulder pads each including a front end flexibly connected to the front thoracic member, a rear end flexibly connected to the upper back member, and a neck edge extending between the front and rear ends in proximity of the neck hole.

9. The protective garment according to claim 8, further comprising a shoulder cap hingedly connected on top of each of the shoulder pads.

10. An upper body protective garment comprising:

a waist assembly adapted to be worn around at least a portion of a waist of a wearer;

a protective back member for protecting a back of the wearer, the back member having a lower portion connected to the waist assembly and an upper portion opposite of the lower portion, the back member including a protective spinal member defined between the upper and lower portions;

shoulder portions extending from the upper portion of the back remember for overlaying shoulders of the wearer; and a protective front thoracic member having a top end connected to the shoulder portions and a bottom end opposite of the top end, the bottom end of the front thoracic member being connected to the waist assembly by a loose connection including a first strap loop extending from an underside of the front thoracic member, and a second strap loop extending from the waist assembly, wherein the first strap loop and the second strap loop are interconnected to provide a movable connection between the front thoracic member and the abdominal member.

11. The protective garment according to claim 10, wherein the loose connection allows relative movement of the bottom end of the front thoracic member with respect to the waist assembly along a limited path.

12. The protective garment according to claim 10, wherein at least the spinal member and the front thoracic member include rigid protective material.

13. The protective garment according to claim 10, wherein the waist assembly includes an abdominal pad.

14. The protective garment according to claim 10, further comprising a flexible strap connected to a top end of the waist assembly and an underside of the front thoracic member.

15. The protective garment according to claim 10, the front thoracic member comprising a single member for overlaying at least a sternum of the wearer.

16. The protective garment according to claim 10, the spinal member providing at least a limited relative rotational range of motion about three perpendicular axes between the upper and lower portions of the back member.

17. A protective garment, comprising:

a lower garment portion including a protective abdominal member wearable around at least a portion of the waist of a wearer;

an upper garment portion including a protective front thoracic member for overlaying at least a sternum of the wearer and shoulder portions for overlaying shoulders of the wearer; and a first loop extending from an underside of the front thoracic member and a second loop extending from the abdominal member, wherein the first loop and the second loop are interconnected to allow relative rotational motion between the front thoracic member and the abdominal member such that the position of the upper garment portion remains substantiallty constant relative to the wearer's shoulders.

18. The protective garment according to claim 17, further comprising a flexible strap connected to a top end of the lower garment portion and an underside of the upper garment portion.

19. The protective garment according to claim 17, wherein the shoulder portions include a pair of protective shoulder pads each including a front end flexibly connected to the front thoracic member, a rear end flexibly connected to an upper back member, and a neck edge extending between the front and rear ends in proximity of a neck hole.

20. The protective garment according to claim 19, further comprising a shoulder cap hingedly connected on top of each of the shoulder pads.

* * * * *

UNITED STATES PATENT AND TRADEMARK OFFICE

CERTIFICATE OF CORRECTION

PATENT NO. : 8,336,124 B2
APPLICATION NO. : 13/302074
DATED : December 25, 2012
INVENTOR(S) : Ryan Crelinsten It is certified that error appears in the above-identified patent and that said Letters Patent is hereby corrected as shown below:

Column 1, line 8: “herein be reference” should read --herein by reference--

Column 7, line 13 (claim 2): “protective ga went according” should read --protective garment according--

Column 7, line 29 (claim 6): “front thoracic; member” should read --front thoracic member--

Column 7, line 40 (claim 8): “further comprising;” should read --further comprising:--

Column 8, line 45 (claim 17): “remains substantiallty constant” should read --remains substantially constant--

Signed and Sealed this
Nineteenth Day of February, 2013

Teresa Stanek Rea
*Acting Director of the United States Patent and Trademark Office*